United States Patent [19]

Richmond

[11] 4,214,247

[45] Jul. 22, 1980

[54] TUNABLE FIBERGLASS WHIP ANTENNA

[75] Inventor: Thomas A. Richmond, Middletown, N.Y.

[73] Assignee: Avnet, Incorporated, Ellenville, N.Y.

[21] Appl. No.: 951,162

[22] Filed: Oct. 13, 1978

[51] Int. Cl.[2] ..... H01Q 1/36

[52] U.S. Cl. ..... 343/752; 343/895

[58] Field of Search ..... 343/715, 745, 895, 752

[56] References Cited

U.S. PATENT DOCUMENTS

| | | | |
|---|---|---|---|
| 2,938,210 | 5/1960 | Harris | 343/895 |
| 3,474,453 | 10/1969 | Ireland | 343/745 |
| 4,097,867 | 6/1978 | Eroncig | 343/750 |

*Primary Examiner*—Eli Lieberman

*Attorney, Agent, or Firm*—Darby & Darby

[57] ABSTRACT

A tunable fiberglass whip antenna comprises an elongated fiberglass core having a conductive wire coiled around the core and serving as the antenna. The uppermost extremity of the wire is tightly coiled around an axial bore within the fiberglass. A metal insert, fixed within the fiberglass bore is in threaded engagement with a set screw accessible from the top of the antenna. By adjusting the longitudinal position of the set screw relative to the tightly wound wire at the end of the antenna, the inductive coupling between the coil and screw is varied to thereby change the effective length of the antenna.

1 Claim, 2 Drawing Figures

TUNABLE FIBERGLASS WHIP ANTENNA

BACKGROUND OF THE INVENTION

This invention pertains to antennas. More particularly, this invention pertains to vehicle mounted fiberglass whip antennas for use with citizens band (CB) frequencies.

When a CB whip antenna is mounted on a vehicle, the vehicle serves as the ground plane for the antenna. Consequently, the size of the vehicle and even the location of the antenna on the vehicle can affect the resonant frequency of the antenna and thus the performance of the antenna in the frequency band of interest. It is therefore desirable to be able to "tune" a citizens band antenna after it is mounted so that its resonant frequency is at the midrange of the frequency band of interest. Conventionally, such tuning is accomplished by varying the length of the antenna. This is generally inconvenient in the case of fiberglass antennas wherein a wire is coiled around a fiberglass core.

OBJECT OF THE INVENTION

The object of this invention is to provide a tunable fiberglass whip antenna for use with citizen band frequencies which is relatively inexpensive and easy to use.

SUMMARY OF THE INVENTION

Briefly, in accordance with the invention, a fiberglass whip antenna comprises a fiberglass core around which is wrapped a conductive wire. The fiberglass core includes an axial bore at its upper end and the wire is tightly coiled around that portion of the fiberglass core. An internally threaded insert which engages a set screw is fixed within the bore. By adjusting the set screw, the user changes the inductive coupling between the tightly wound coil and the screw, and thereby changes its effective length.

THE DRAWINGS

The invention is described below with reference to the annexed drawings wherein

DETAILED DESCRIPTION

Figure 1:
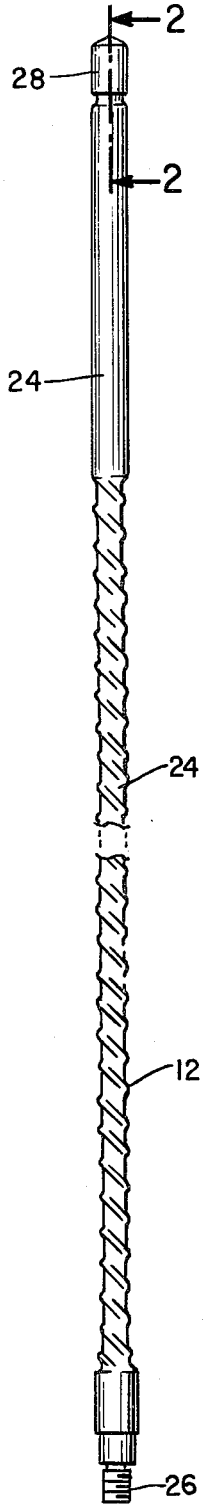
FIG. 1 is a plan view of a fiberglass whip antenna.
Figure 2:
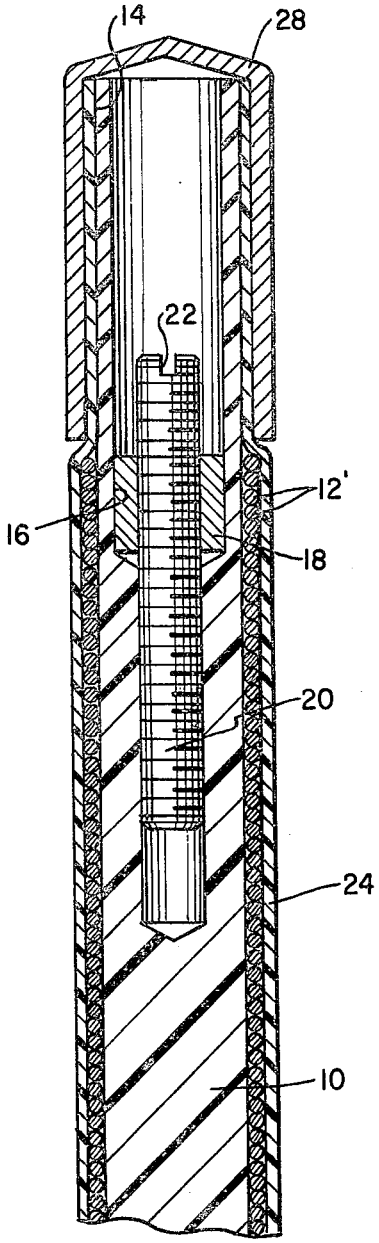
FIG. 2 is a sectional view along the line 2—2 of FIG. 1

The invention comprises an elongated whip-like fiberglass core 10 around which is wrapped a copper wire 12. The entire length of the antenna may be about four feet with the uper portion 12' of the wire coil (for example the last seven and one-half inches) being tightly coiled. The diameter of the core is about one-half inch. At the upper end of the antenna a two-step axial bore, comprising a large diameter section 14 and a small diameter section 16, extends into the fiberglass core 10.

An annular insert 18, threaded on its interior surface, is located at the base of the large diameter bore section 14. The threads of insert 18 engage the threads of a metal set screw 20 so that the longitudinal position of the metal screw 20 relative to the coil 12' can be changed by rotating the screw via a screw driver inserted into a slot 22.

The annular insert 18 may comprise a commercially available device made of brass and sold under the brand name BARB-SERT. This device includes small barbs on its exterior surface so that when it is force-fit into place, it cannot readily be removed. The entire construction as described is covered with a shrink tube 24 which may be a polyethylene film that shrinks upon application of heat. The bottom of the antenna may terminate in a standard coupling 26 which can be electrically connected to a citizens band receiver. The antenna is mounted in any suitable fashion on a vehicle by standard mounting devices (not shown). The top of the antenna is covered by a plastic cap 28 which, along with the shrink tube 24, serves to protect the elements of the antenna from the environment.

In use, after the antenna has been mounted and connected to the receiver, the user may adjust the position of the metallic set screw 20 by means of a screwdriver inserted throught the top of the antenna into screw slot 22. Since the inductive coupling between the metallic screw and the coil 12' varies as the screw is longitudinally moved, the effect is to vary the effective length of the antenna which serves, in a well-known way, to "tune" the antenna. Preferably, the antenna should be tuned to the center frequency of the band of interest.

What I claim is:

1. A tunable fiberglass whip antenna comprising an elongated tubular fiberglass core having a two-step axial bore at its upper end, a conductive coil wrapped around the exterior surface of said fiberglass core with the upper portion of said coil being tightly wound and enveloping said bore, an internally threaded insert secured at the bottom of the large diameter section of said bore near the top of said coil, and a metallic screw in threaded engagement with the insert and adapted to extend through said insert from beyond the top of said coil into the small diameter portion of said bore, whereby said screw may be longitudinally adjusted relative to said tightly wound coil by rotation of said screw within said insert to thereby vary the inductive coupling between said tightly wound coil and said screw, said core and coil are enveloped in a plastic shrink tube, the open end of said axial bore being enclosed by a cap.

* * * * *